US007451896B2

(12) United States Patent
Robinson

(10) Patent No.: US 7,451,896 B2
(45) Date of Patent: Nov. 18, 2008

(54) CHILD-RESISTANT DISPENSING CLOSURE, PACKAGE AND METHOD OF MANUFACTURE

(75) Inventor: Philip J. Robinson, Sylvania, OH (US)

(73) Assignee: Owens-Illinois Closure, Inc., Perrysburg, OH (US)

( * ) Notice: Subject to any disclaimer, the term of this patent is extended or adjusted under 35 U.S.C. 154(b) by 72 days.

(21) Appl. No.: 10/975,689

(22) Filed: Oct. 27, 2004

(65) Prior Publication Data

US 2006/0086757 A1 Apr. 27, 2006

(51) Int. Cl.
*B67B 5/00* (2006.01)

(52) U.S. Cl. ..... 222/153.14; 215/211

(58) Field of Classification Search ..... 222/153.14, 222/153.13, 153.01, 153.1; 215/211, 216, 215/209, 206, 205, 212
See application file for complete search history.

(56) References Cited

U.S. PATENT DOCUMENTS

| | | | | |
|---|---|---|---|---|
| 3,790,015 | A * | 2/1974 | Imamura | 215/209 |
| 3,830,383 | A | 8/1974 | Schaefer | |
| 4,209,100 | A | 6/1980 | Uhlig | |
| 4,513,888 | A | 4/1985 | Curry | |
| 4,629,081 | A | 12/1986 | McLaren | |
| 4,759,455 | A | 7/1988 | Wilson | |
| 4,826,026 | A * | 5/1989 | Gach et al. | 215/206 |
| 4,982,882 | A | 1/1991 | Gueret | |
| 5,031,784 | A | 7/1991 | Wright | |
| 5,356,017 | A | 10/1994 | Rohr et al. | |
| 5,573,127 | A | 11/1996 | Takahashi et al. | |
| 5,577,626 | A | 11/1996 | Henkel et al. | |
| 5,579,957 | A | 12/1996 | Gentile et al. | |
| 5,860,543 | A | 1/1999 | Decelles | |
| 6,170,710 | B1 | 1/2001 | Suffa | |
| 2002/0175137 | A1 | 11/2002 | Rousselet | |

FOREIGN PATENT DOCUMENTS

| | | |
|---|---|---|
| EP | 0379775 | 8/1990 |

* cited by examiner

*Primary Examiner*—Lien M. Ngo

(57) ABSTRACT

A child-resistant dispensing closure includes a base having a deck, a dispensing opening in the deck and a peripheral skirt extending from the deck. A lid is integrally hinged to the base for movement between a closed position overlying the deck and an open position spaced from the deck. The base has an opening in the deck adjacent to the peripheral skirt and opposite from the hinge, and a tab extends from the skirt adjacent to the opening. The lid has a lug for snap-coupling over an exterior of the tab in the closed position of the lid. The peripheral skirt is resiliently flexibly moveable into the opening to move the tab out of engagement with the lug on the lid skirt and thereby permit movement of the lid to the open position.

10 Claims, 3 Drawing Sheets

CHILD-RESISTANT DISPENSING CLOSURE, PACKAGE AND METHOD OF MANUFACTURE

The present invention is directed to hinged-lid dispensing closures, packages and methods of manufacture, and more particularly to provision of a child-resistance feature on such a closure or package.

BACKGROUND AND SUMMARY OF THE INVENTION

Fluid dispensing closures typically have a one-piece integrally molded plastic shell that includes a base and a lid integrally connected to the base by one or more hinge elements. The base includes a dispensing opening through which product can be dispensed in the open position of the lid, and through which dispensing is blocked in the closed position of the lid. U.S. Pat. Nos. 4,638,916, 5,489,035 and 5,913,435 illustrate dispensing closures of this general type. Child-resistance features on dispensing closures of this type tend to be undesirably complex and/or undesirably costly in terms of the mass of plastic and the consequent cost of manufacture. A general object of the present invention is to provide a hinged-lid-type child-resistant dispensing closure, package and method of manufacture in which child-resistance features are simply and economically implemented.

A child-resistant dispensing closure in accordance with one aspect of the present invention includes a base having a deck, a dispensing opening in the deck and a peripheral skirt extending from the deck. A lid is integrally hinged to the base for movement between a closed position overlying the deck and an open position spaced from the deck. The base has an opening in the deck adjacent to the peripheral skirt and opposite from the hinge, and a tab extends from the skirt adjacent to the opening. The lid has a lug for snap-coupling over an exterior of the tab in the closed position of the lid. The peripheral skirt on the base is resiliently flexibly moveable into the opening to move the tab out of engagement with the lug on the lid skirt and thereby permit movement of the lid to the open position. In the preferred embodiment, and in accordance with another aspect of the invention, the lid has a skirt with the lug being interiorly disposed on the lid skirt. The base has a ledge for engagement by the lid skirt in the closed position of the lid. The ledge has an outside peripheral dimension that is greater than the corresponding outside peripheral dimension of the lid skirt so that the lid cannot readily be pushed or urged away from the base in the absence of resilient flexure of the base skirt to provide an area for engagement with the lid.

A child-resistant dispensing closure in accordance with a further aspect of the invention includes a base having a deck, a dispensing opening in the deck, a peripheral skirt extending from the deck, an inner skirt extending from the deck within and spaced from the peripheral skirt, and a ledge recessed from the deck around the peripheral skirt. A lid is integrally hinged to the base for movement between a closed position overlying the deck and an open position spaced from the deck. The lid has a skirt for engagement with the ledge around the base in the closed position of the lid. The lid skirt has a peripheral dimension that is less than the corresponding peripheral dimension of the ledge, such that the lid skirt is recessed inwardly on the deck ledge in the closed position of the lid. The base has an arcuate opening in the deck between the inner skirt and the peripheral skirt, such that the peripheral skirt is resiliently flexibly moveable into the arcuate opening so that the lid skirt can be engaged to open the lid. The peripheral skirt has at least one interior channel adjacent to the arcuate opening to localize flexible movement of the peripheral skirt. In the preferred embodiment in accordance with this aspect of the invention, the base has a tab extending from the peripheral skirt adjacent to the arcuate opening, and the lid includes a lug for snap-coupling over the exterior of the tab. The peripheral skirt preferably has a pair of parallel interior channels positioned on opposite sides of the tab for localizing flexure of the peripheral skirt to the area of the tab.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 5:
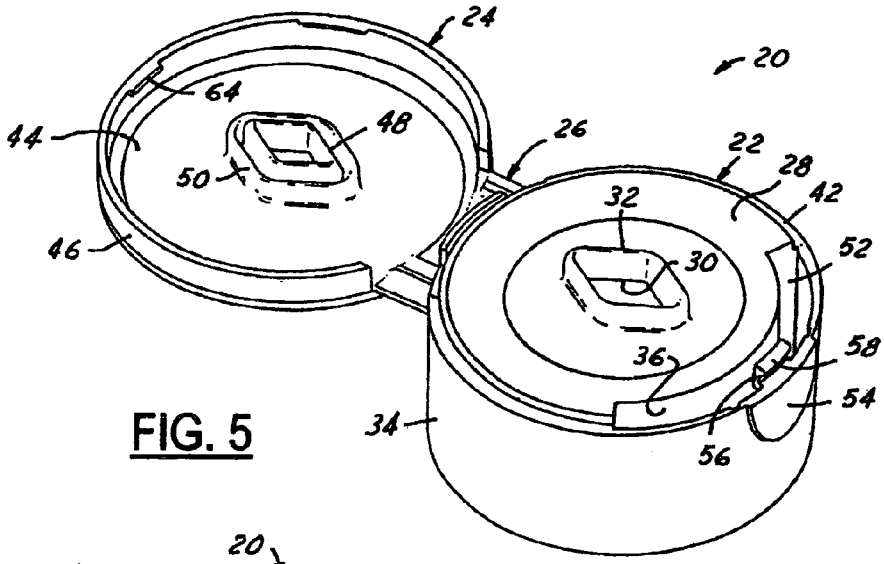
FIG. 5 is a perspective view of the dispensing closure in FIGS. 1-4 with the lid in the open position.
Figure 6:
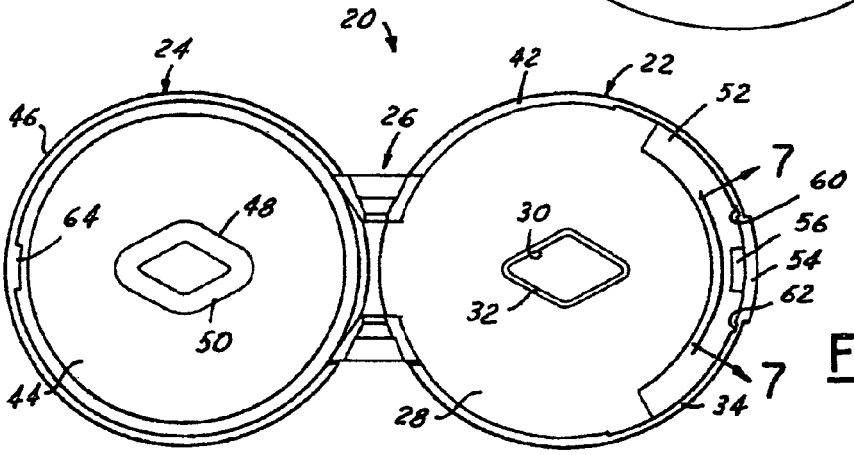
FIG. 6 is a top plan view of the dispensing closure in FIG. 5.

FIGS. 1-4 illustrate a child-resistant package 10 in accordance with one presently preferred embodiment of the invention as including a container 12 having a neck 14 with an axially extending radially inwardly recessed finish 16. Finish 16 has one or more external threads or thread segments 18 for securement of a child-resistant dispensing closure 20. As best seen in FIGS. 5 and 6, dispensing closure 20 includes a shell of one-piece construction, preferably integrally molded plastic construction. Closure 20 includes a base 22 to which a lid 24 is attached by a pivot hinge 26. Hinge 26 preferably is of the type illustrated in U.S. Pat. No. 6,041,477. Hinge 26 alternatively, but less preferably, may be of the type illustrated in U.S. Pat. Nos. 4,638,916 or 5,489,035, or any other suitable hinge construction.

Closure base 22 includes a deck 28 having a dispensing opening 30 surrounded by an outwardly extending wall 32. An outer peripheral skirt 34 extends from the underside of deck 28, and an inner skirt 36 extends from the underside of deck 28 at a position spaced radially inwardly from peripheral skirt 34. Inner skirt 36 is cylindrical, and has one or more internal threads or thread segments 38 for engagement with external threads or thread segments 18 on container neck finish 16. Other closure/container attachment means, such as interlocking beads, can be employed; however, interlocking threads are currently preferred. An annular wall 40 extends from the underside of deck 28 within skirt 36 for plug-sealing engagement within the open end or mouth of container neck finish 16. Peripheral skirt 34 is illustrated as being cylindrical in the preferred embodiment of the invention, and deck 28 is illustrated as circular. However, the periphery of deck 28 and outer peripheral skirt 34 may be of other geometries, such as oval, to blend with the underlying adjacent contour of container 12.

A shoulder or ledge 42 is axially recessed beneath the level of deck 28 around peripheral skirt 34, and has an axially upwardly facing surface that preferably lies in a plane perpendicular to the axis of inner skirt 36. (Directional words such as "upper" and "under" are employed by way of description and not limitation with respect to the upright orientation of the closure and container illustrated in FIGS. 2 and 3. Directional words such as "radial" and "axial" are employed by way of description and not limitation with respect to the central axis of container neck finish 16 or closure inner skirt 36 as appropriate.) Lid 24 includes a base wall 44 and a peripheral skirt 46 having a geometry that matches the peripheral geometry of base 22. Concentric annular walls 48,50 extend from deck base wall 44 for receipt within and around the outside of wall 32 on base 22 in the closed position of the lid illustrated in FIG. 2.

Figure 7:
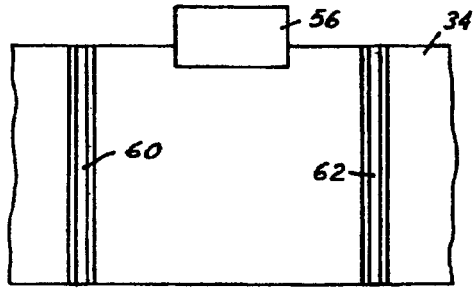
FIG. 7 is a fragmentary sectional view taken substantially along the line 7-7 in FIG. 6.

An arcuate opening 52 extends through deck 28 at a position diametrically opposite from hinge 26. Arcuate opening 52 extends radially inwardly from peripheral skirt 34, preferably but not necessarily to inner skirt 36 between inner skirt 36 and outer skirt 34, as best seen in FIGS. 2-3 and 5-6. Arcuate opening 52 extends angularly from the central line of symmetry of closure 20, over a distance of about 60\ on each side of the line of symmetry in FIG. 6 in the illustrated embodiment of the invention. Outer peripheral skirt 34 is thickened, at a point diametrically opposite from hinge 26, to form an external pressure pad 54 to facilitate opening of the closure lid. A tab 56 extends axially from pad 54 on peripheral skirt 34, and has an outwardly extending lug or bead 58 at the end of the tab 56. As best seen in FIGS. 5-7, a pair of parallel axial channels 60,62 extend along the interior surface of peripheral skirt 34 on respective opposed sides of tab 56. A lug or bead 64 is interiorly positioned on lid skirt 46 at a position diametrically opposite from hinge 26.

Figure 1:
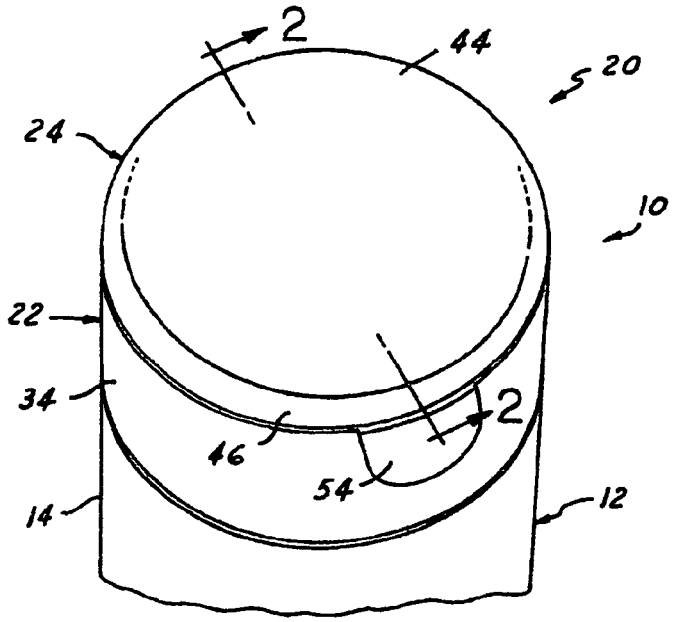
FIG. 1 is a fragmentary perspective view of a package in accordance with one presently preferred embodiment of the invention.
Figure 2:
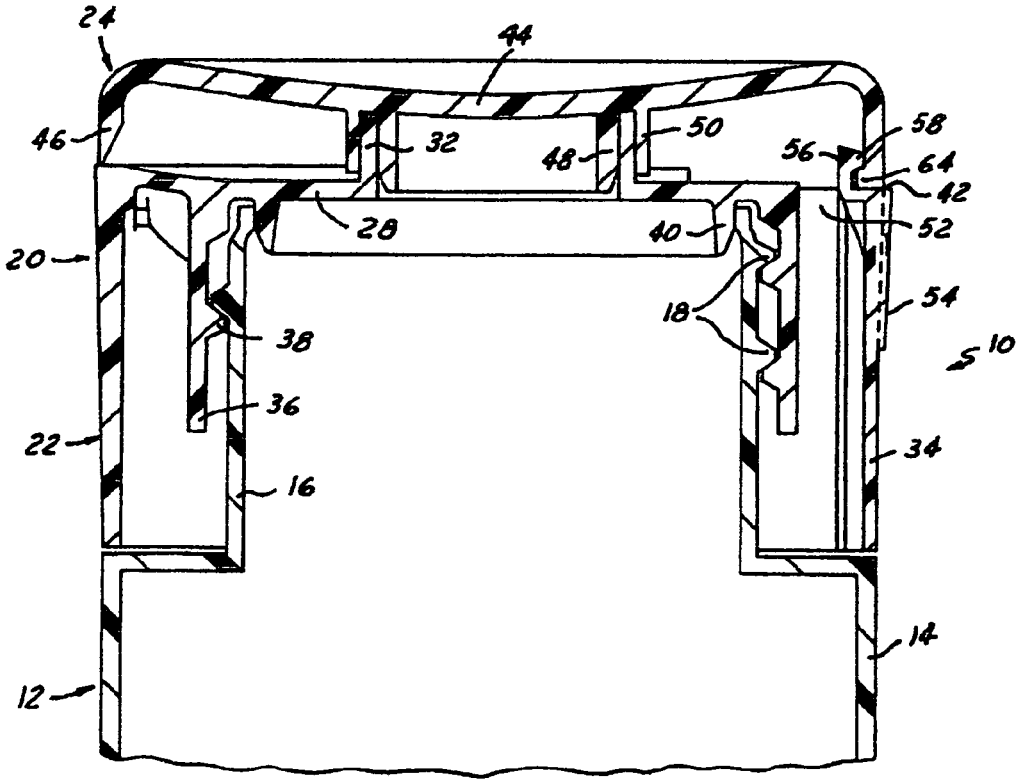
FIG. 2 is a fragmentary sectional view of the package in FIG. 1 with the lid of the dispensing closure in the closed position.
Figure 3:
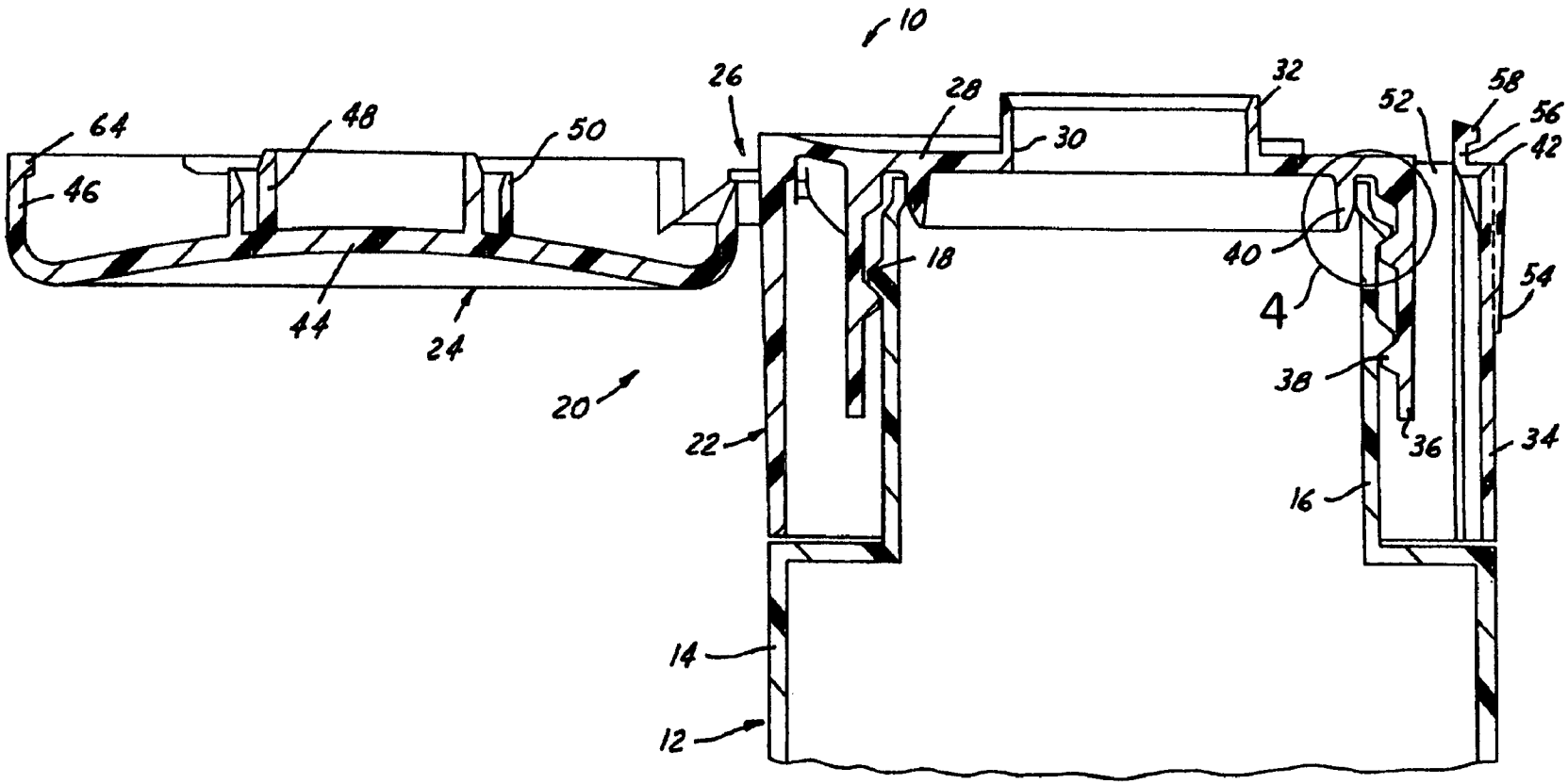
FIG. 3 is a fragmentary sectional view that is similar to that of FIG. 2 but shows the closure lid in the open position.
Figure 4:
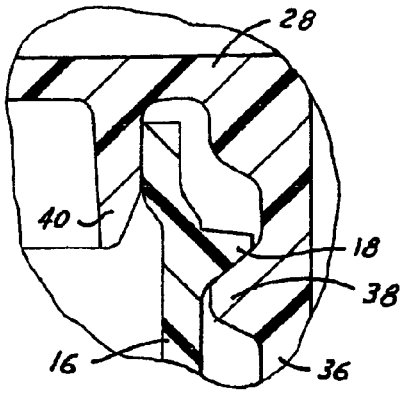
FIG. 4 is a fragmentary sectional view of the portion of FIG. 3 within the area 4.

In the closed position of closure lid 24 illustrated in FIG. 2, interior lug 64 on lid skirt 46 is received by snap-fit beneath lug 58 on tab 56. To open lid 24, manual pressure is applied to pad 54 so as to flex outer peripheral skirt 34 radially inwardly into arcuate opening 52. Channels 60, 62 on opposed sides of tab 56 act as hinges to help localize this inward flexure to the area of the tab. Inward flexure of peripheral skirt 34 moves tab 56 radially inwardly so that lug 58 on tab 56 clears lug 64 on lid skirt 46. The undersurface of lid skirt 46 at lug 64 can then be engaged by the user's thumb or finger to move lid 24 to the open position. In this connection, it will be noted in FIGS. 1 and 2 that the outer peripheral dimension of lid skirt 46—i.e., the outer diameter of the lid skirt in the case of a circular lid—is less than the outer peripheral dimension of deck ledge 42. Thus, the user's thumb or other finger cannot readily engage the underside of the lid skirt until base peripheral skirt 34 is resiliently flexed radially inwardly. It is envisioned that this lid skirt/ledge geometry, in combination with a snap-hinge arrangement that resiliently biases the lid against the base ledge, provides a child-resistance feature even without tab 56 and lid lug 64. However, provision of tab 56 and lug 64 is currently preferred.

Closure 20, including base 22, lid 24 and hinge 26 preferably is of integrally molded plastic construction such as polypropylene. The illustrated geometries of dispensing opening 30 and walls 32, 48, 50 are merely exemplary. Likewise, the circular peripheral geometry of the dispensing closure is exemplary, as noted above. It is also envisioned that a dispensing valve can be mounted within dispensing opening 30, as illustrated for example in U.S. Pat. No. 6,672,487 or U.S. application Ser. No. 10/874,036.

There have thus been disclosed a child-resistant dispensing closure, package and method of manufacture that fully achieve all of the objects and aims set forth above. The invention has been disclosed in conjunction with one presently preferred embodiment thereof, and a number of modifications and variations have been discussed. Other modifications and variations will readily suggest themselves to persons of ordinary skill in the art in view of the foregoing description. The invention is intended to embrace all such modifications and variations as fall within the spirit and broad scope of the appended claims.

The invention claimed is:

1. A child-resistant dispensing closure that includes:

a base having a deck, a dispensing opening in said deck and a peripheral skirt extending from said deck, and a lid integrally hinged to said base for movement between a closed position overlying said deck and an open position spaced from said deck, said base having an opening in said deck adjacent to said peripheral skirt opposite from the hinge, and a tab extending from said peripheral skirt adjacent to said opening, said lid having a lug for snap-coupling over an exterior of said tab in said closed position of said lid, said peripheral skirt being resiliently flexibly moveable into said opening to move said tab out of engagement with said lug and permit movement of said lid to said open position, said lid having a skirt with said lug being interiorly disposed on said skirt, and said base having a ledge for engagement by said lid skirt in said closed position of said lid, said ledge having an outside peripheral dimension that is greater than the corresponding outside peripheral dimension of said lid skirt, said peripheral skirt being continuous and imperforate having an exterior thickened pressure pad adjacent to said tab and a pair of parallel interior channels on opposed sides of said pressure pad to localize inward flexing of said skirt and tab upon application of pressure to said pressure pad, said hinge comprising a snap hinge that resiliently biases said lid against said ledge so that inward flexure of said peripheral skirt both releases said tab from engagement with said lid and permits application of opening pressure on an underside of said lid skirt.

2. The closure set forth in claim 1 wherein said base has an inner skirt extending from said deck within and spaced from said peripheral skirt, and wherein said opening in said deck adjacent to said peripheral skirt is disposed between said peripheral skirt and said inner skirt.

3. The closure set forth in claim 2 wherein said inner skirt is cylindrical, and wherein said opening in said deck adjacent to said peripheral skirt is an arcuate opening disposed between said inner skirt and said peripheral skirt.

4. The closure set forth in claim 1 wherein said peripheral skirt is cylindrical.

5. The closure set forth in claim 3 including an annular wall extending from said deck within said inner skirt and around said dispensing opening for plug-sealing engagement within a container mouth.

6. A child-resistant package that includes a container having a neck finish and a child-resistant on said neck finish, said child-resistant closure including:

a base having a deck, a dispensing opening in said deck and a peripheral skirt extending from said deck, and a lid integrally hinged to said base for movement between a closed position overlying said deck and an open position spaced from said deck, said base having an opening in said deck adjacent to said peripheral skirt opposite from the hinge, and a tab extending from said peripheral skirt adjacent to said opening, said lid having a lug for snap-coupling over an exterior of said tab in said closed position of said lid, said peripheral skirt being resiliently flexibly moveable into said opening to move said tab out of engagement with said lug and permit movement of said lid to said open position, said lid having a skirt with said lug being interiorly disposed on said skirt, and said base having a ledge for engagement by said lid skirt in said closed position of said lid, said ledge having an outside peripheral dimension that is greater than the corresponding outside peripheral dimension of said lid skirt, said peripheral skirt being continuous and imperforate having an exterior thickened pressure pad adjacent to said tab and a pair of parallel interior channels on opposed sides of said pressure pad to localize inward flexing of said skirt and tab upon application of pressure to said pressure pad, said hinge comprising a snap hinge that resiliently biases said lid against said ledge so that inward flexure of said peripheral skirt both releases said tab from engagement with said lid and permits application of opening pressure on an underside of said lid skirt.

7. The package set forth in claim 6 wherein said base has an inner skirt extending from said deck within and spaced from said peripheral skirt, and wherein said opening in said deck adjacent to said peripheral skirt is disposed between said peripheral skirt and said inner skirt.

8. The package set forth in claim 7 wherein said inner skirt is cylindrical, and wherein said opening in said deck adjacent to said peripheral skirt is an arcuate opening disposed between said inner skirt and said peripheral skirt.

9. The package set forth in claim 6 wherein said peripheral skirt is cylindrical.

10. The package set forth in claim 8 including an annular wall extending from said deck within said inner skirt and around said dispensing opening for plug-sealing engagement within a container mouth.

* * * * *